US006788181B2

(12) United States Patent
Yeh et al.

(10) Patent No.: US 6,788,181 B2
(45) Date of Patent: Sep. 7, 2004

(54) CHASSIS OF SURFACE MOUNTED INDUCTOR

(75) Inventors: Ming Yeh, Taipei Hsien (TW); Heng Cheng Chou, Taipei Hsien (TW); Ying Teng Chang, Yunlin Hsien (TW); Jen Chieh Huang, Taoyuan Hsien (TW)

(73) Assignee: Delta Electronics Inc., Taoyuan Sien (TW)

( * ) Notice: Subject to any disclaimer, the term of this patent is extended or adjusted under 35 U.S.C. 154(b) by 0 days.

(21) Appl. No.: 09/929,068

(22) Filed: Aug. 15, 2001

(65) Prior Publication Data

US 2002/0057168 A1 May 16, 2002

(30) Foreign Application Priority Data

Aug. 18, 2000 (TW) ..... 89214286 U

(51) Int. Cl.[7] ..... H01F 27/29
(52) U.S. Cl. ..... 336/192; 336/200
(58) Field of Search ..... 336/15, 83, 183, 336/185, 192, 198, 200, 232

(56) References Cited

U.S. PATENT DOCUMENTS 5,307,041 A * 4/1994 Kato et al. ..... 336/83
5,751,203 A * 5/1998 Tsutsumi et al. ..... 336/65

FOREIGN PATENT DOCUMENTS

JP 2-256212 * 10/1990
JP 10-284331 * 10/1998 ..... 336/200

* cited by examiner

*Primary Examiner*—Tuyen T. Nguyen
(74) *Attorney, Agent, or Firm*—Birch, Stewart, Kolasch & Birch, LLP

(57) ABSTRACT

The present invention discloses a base for transforming an inductor consisting of a core and a coil having two terminals into a surface mounted device. The present invention includes an insulating element, a substantially Z-shaped first conductive element and a substantially Z-shaped second conductive element. The first conductive element and the second conductive element further include a strip of first stem and a strip of second stem, respectively. The insulating element partially exposes lower surfaces of the first and second conductive elements and the first and second stems. The remaining portions of the first and second conductive elements are embedded in the insulating element. A terminal of the first conductive element extends toward the second conductive element and crosses a virtual cross-sectional line. Each of the terminals of the coil is wound around the respective recessed edge of the stems.

17 Claims, 5 Drawing Sheets

CHASSIS OF SURFACE MOUNTED INDUCTOR

BACKGROUND OF THE INVENTION

1. Field of the Invention

The present invention relates to a chassis of inductor, and more particularly to a chassis of surface mounted inductor.

2. Description of the Prior Art

Generally, the conventional inductor fails to sever as a surface mounted device (SMD) due to the pin-shaped terminals of the coil. A chassis having strips of stem is required to transform the conventional inductor into a surface mounted device. As shown in FIG. 1, the conventional chassis 20 includes an upper surface and a flat bottom surface (not shown). The upper surface further includes a cavity 21 and two U-shaped metal parts 30 formed on the periphery of the cavity. Each of the metal parts 30 is embedded into the periphery of the chassis 20 and provides a lower surface to electrically contact with the board.

Still referring to FIG. 1, to transform the conventional inductor into a surface mounted inductor 70, the core 11 of the inductor is partially positioned in the cavity 21. Then, a conductive line is wound around the core 11 to form the coil 12. Finally, the pin-shaped terminals of the coil 12 are connected with the metal parts 30, i.e. by welding. After that, the conventional inductor can serve as a surface mounted inductor.

However, the conventional chassis exhibits the following disadvantages. First, the bottom surface of the conventional surface mounted inductor 70 fails to provide satisfying flatness since the U-shaped metal parts 30 are partially embedded into the chassis 20. Using welding to connect the coil 12 with the metal parts 30 consumes power and may cause danger. The terminals of the coil originally connecting with the metal parts 30 tend to loosen. The chassis 20 is made of plastic and thus fragile if the thickness is not enough. However, during trying to increase the thickness to enhance the strength, the profile of the chassis is inevitably increased. The shape of the conventional surface mounted inductor 70 is symmetrical and the apparatus fails to automatically identify the direction of the magnetic filed during using. Therefore, it is confusing and inconvenient. The conventional surface mounted inductor needs additional identification mark, such as the dots 60.

Accordingly, there has been a strongly felt need for a novel chassis for improving the disadvantages described above.

SUMMARY OF THE INVENTION

Consideration of the disadvantages of the conventional chassis described above, the main object of the present invention is to provide an improved chassis can overcome the aforementioned problems.

The present invention discloses a chassis for transforming an inductor into a surface mounted device. The present inductor includes a core and a coil wound around the core and having two pin-shaped terminals. The chassis further includes an insulating element (i.e. plastic), a first conductive element and a second conductive element. The insulating element further includes an upper surface having a cavity and a flat bottom surface.

The first conductive element and the second conductive element substantially are Z-shaped and have a strip of first stem and the second stem, respectively. The insulating element exposes the first stem and the portion of the lower surface of the first conductive element. The remaining portion of the first conductive element is embedded into the insulating element. The insulating element exposes the second stem and the portion of the lower surface of the second conductive element. The remaining portion of the second conductive element is embedded into the insulating element. Besides, the exposed lower surface of the first conductive element, the exposed lower surface of the second conductive element and the bottom surface of the chassis are arranged on the same level. Moreover, one section of the first conductive element extends toward the second stem and further crosses the virtual second cross-sectional line.

According to the present invention, the core is partially positioned on the first cavity of the chassis. In addition, the pin-shaped terminals of the coil are further wound around the stems and so as to form combination. In this manner, the inductor is transformed into a surface mounted inductor by means of the chassis.

Compared to prior art, the present invention at least exhibits the advantages described as follows. The bottom surface of the present surface mounted inductor provides satisfying flatness since the exposed lower surface of the first conductive element, the exposed lower surface of the second conductive element and the bottom surface of the chassis are arranged on the same level. The terminals of the coil are wound around the conductive elements such that the consumed power for welding is not required. The terminals of the coil wound around the notchs of the stems are fixed properly. Since the Z-shaped first and second conductive elements are partially embedded into the insulating element, the rigidness of the insulating element is enhanced. Alternatively, the insulating element can be decreased meanwhile keeping the rigidness. The shape of the present surface mounted inductor is unsymmetrical and the direction of the magnetic filed can be automatically identified during using. That is, the additional identification mark can be omitted.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, which are given by way of illustration only, and thus are not limitative of the present invention, and wherein:

FIG. 3(*b*) depicts the top plan view illustrating the chassis according to the present invention;

FIG. 4(*b*) depicts the partially amplified side view illustrating the chassis according to the present invention.

DESCRIPTION OF THE PREFERRED EMBODIMENT

Figure 1:
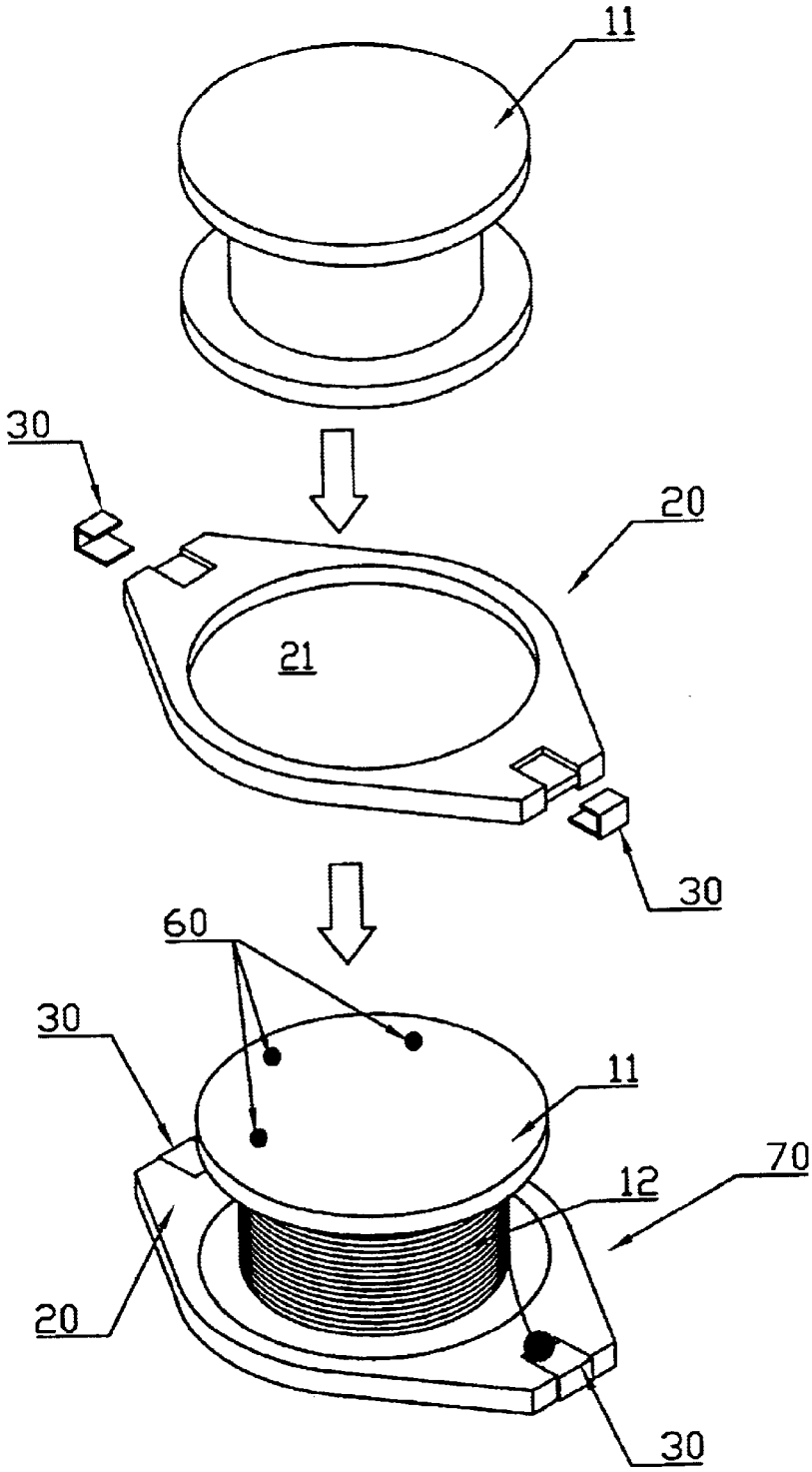
Fig.1 BACKGROUND ART
FIG. 1 depicts a conventional chassis used in a surface mounted inductor.
Figure 2:
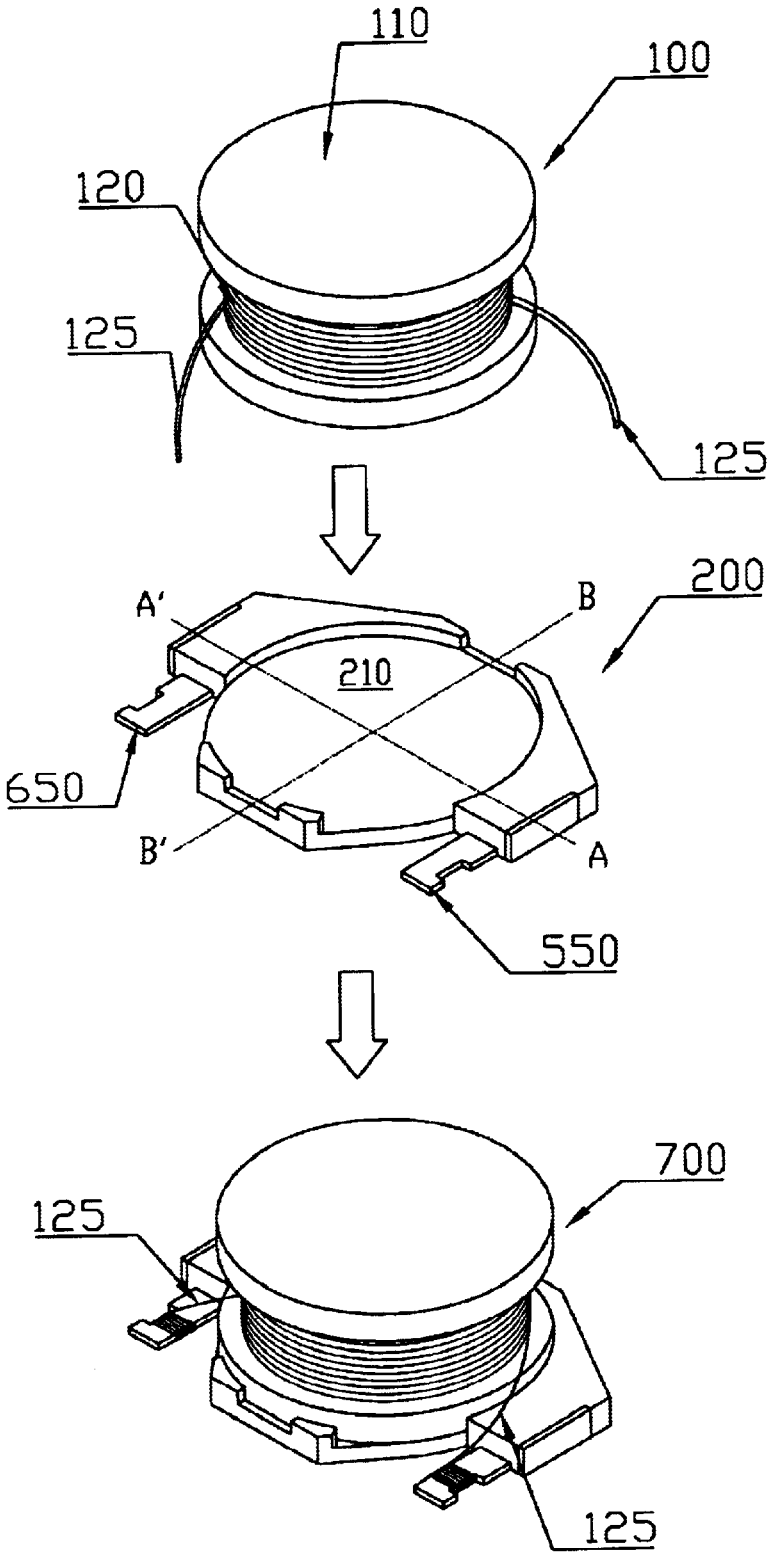
FIG. 2 depicts the chassis having the inductor formed thereon according to the present invention.

The present invention discloses a chassis 200 for transforming an inductor into a surface mounted device. As shown in FIG. 2, the present inductor 100 includes a core 110 and a coil 120. The coil 120 is wound around the core 110 and thus has two pin-shaped terminals 125. The chassis 200 includes an upper surface having a first cavity 210 and strips of stems 550 and 650. The first cavity 210 accommodates a part of the inductor 100 (i.e. the bottom surface of the core 110). Besides, the pin-shaped terminals 125 are further wound around the stems 550 and 650 so as to form combination. In this manner, the inductor is transformed into a surface mounted inductor 700 by means of the chassis 200.

Figure 3A:
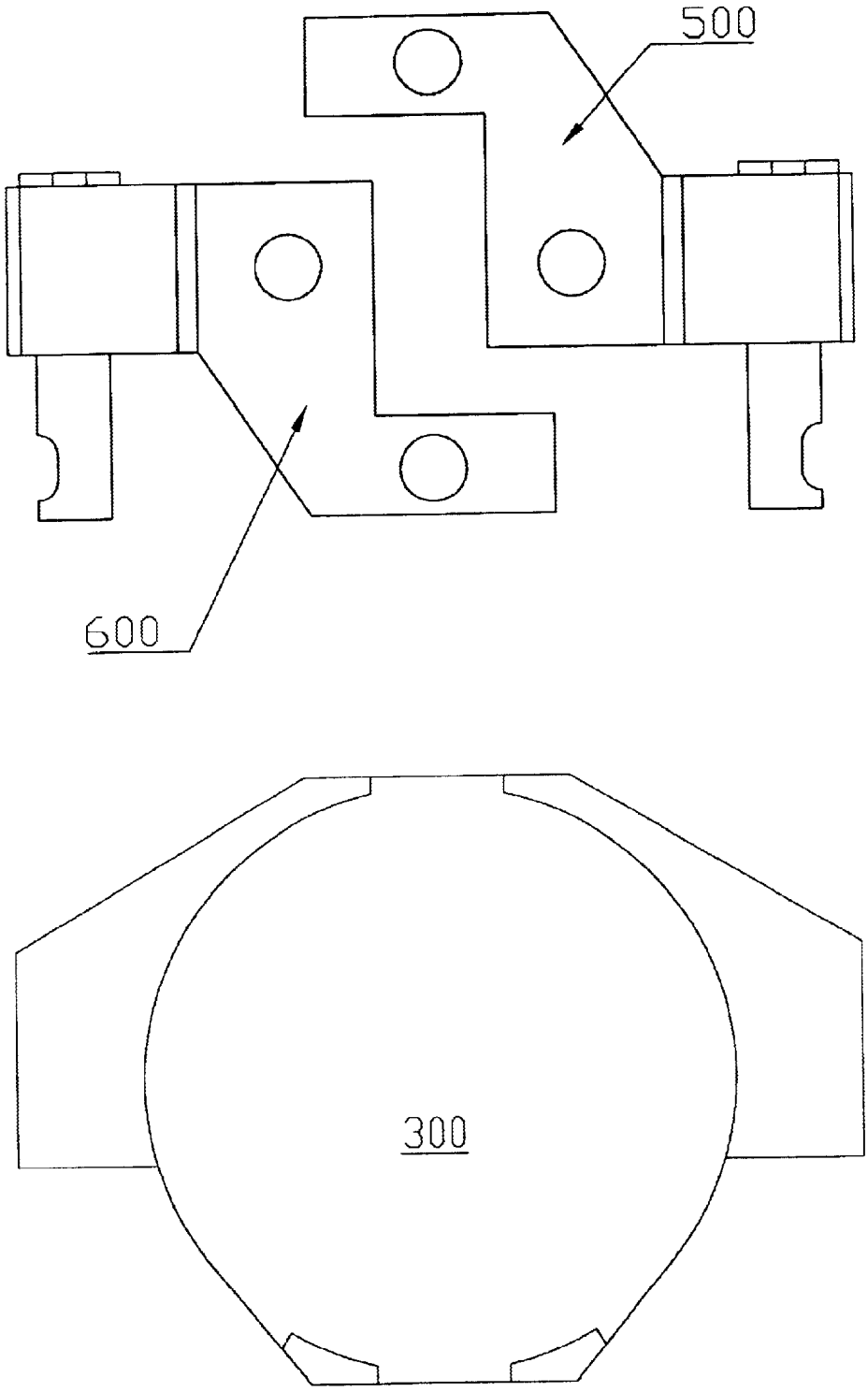
FIG. 3(*a*) depicts the exploded view illustrating the chassis according to the present invention.
Figure 3B:
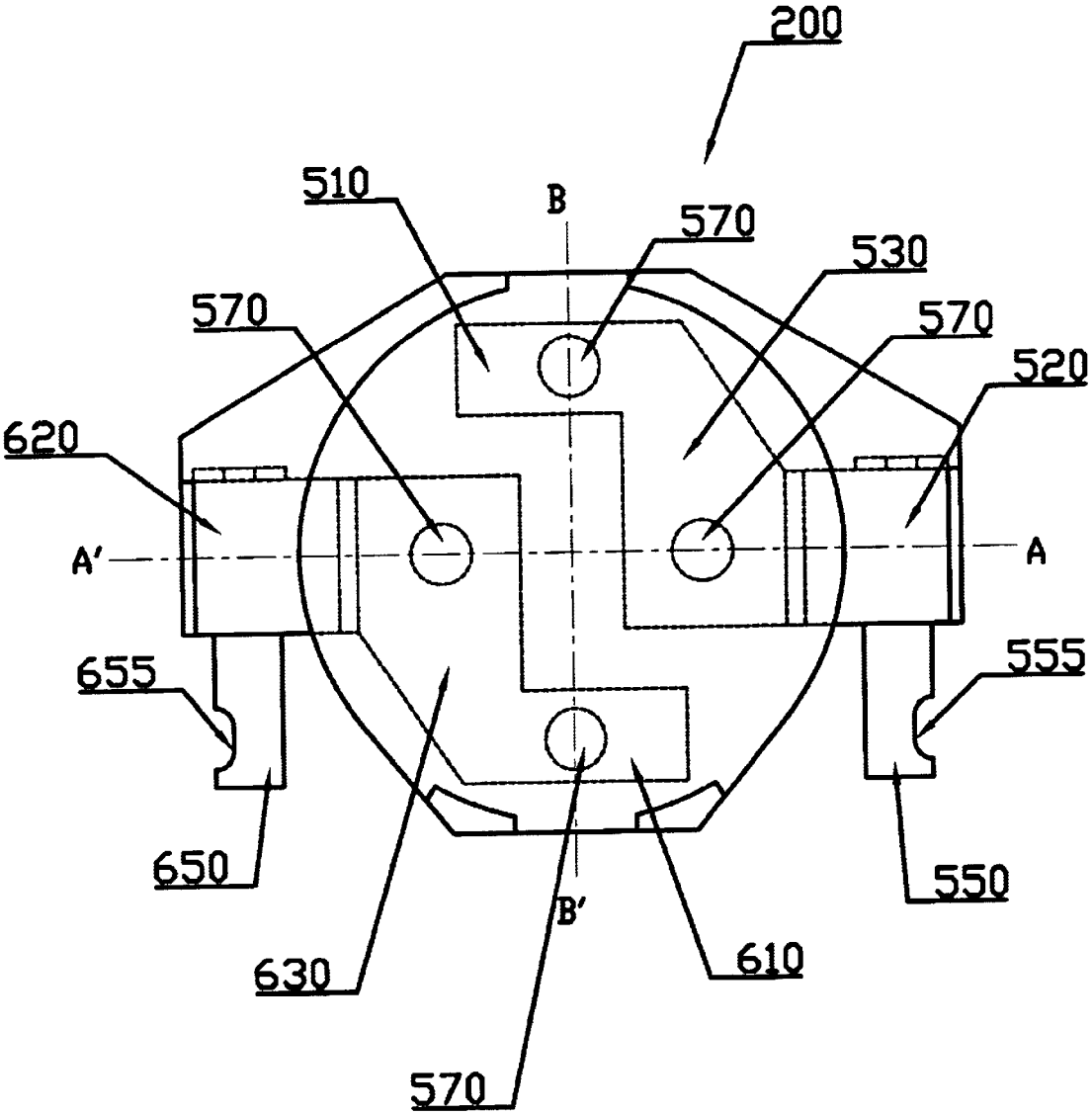

Referring to FIG. 2 and FIG. 3(*a*), the chassis 200 further includes an insulating element 300, a first conductive element 500 and a second conductive element 600. The insulating element 300 further includes an upper surface and a flat bottom surface (not shown). As described above, the upper surface has a first cavity 210 accommodating the bottom surface of the core 110 of the inductor 100. Among these, the bottom surface of the chassis 200 is flat and attached to a board (not shown) during using.

Referring to FIG. 3(*b*), the first conductive element 500 further includes a first section 510, a second section 520 and a first step section 530. The second conductive element 600 further includes a third section 610, a fourth section 620 and a second step section 630. Among these, the first section 510, the first step section 530, the third section 610 and the second step section 630 is embedded into (i.e. by molding) the insulating element 300. The second section 520 and the fourth section 620 are formed on the periphery of the insulating element 300. Additionally, the second section 520 and the fourth section 620 further include a strip of first stem 550 and a second stem 650, respectively. The insulating element 300 exposes the first stem 550 and the second stem 650. The insulating element 300 also exposes the lower surfaces of the second section 520 and the fourth section 620, explained in greater detail below. That is, the second section 520 and the fourth section 620 are partially embedded into the insulating element 300.

Still referring to FIG. 3(*b*), note that the chassis 200 is unsymmetrical chassisd on a view along the first cross-sectional line, such as the horizontal cross-sectional line AA' passing through the center of the chassis 200. To expose the first stem 550 and the second stem 650, the upper portion and the lower portion of the insulating element 300 separated by the cross-sectional line AA' are unsymmetrical to each other. Among these, the exposed first stem 550 and the second stem 650 are located on the lower portion. Therefore, according to the present invention, the desired direction of the magnetic field can be previously determined automatically, rather than manually, during assembling. Besides, the present invention can be packaged in a tape reel and meanwhile oriented toward the same direction by a suitable container matching the shape of the present inductor formed on the tape reel. Because the present inductor fails to be packaged in the tape reel if an incorrect orientation is given. Contrary to the present invention, it is unable to identify the desired direction of the magnetic field of the conventional inductor automatically during assembling since the conventional inductor is symmetrical. In this case, the desired orientations of the conventional inductors packaged in a tape reel tend to be confused, which cause inconvenience. For example, the desired direction of the magnetic field of the conventional inductors packaged in a tape reel may be oriented toward the different directions. The above-mentioned first cross-sectional line may be a virtual line extending form the second section 520 to the fourth section 620. Besides, the first cross-sectional line is perpendicular to the second cross-sectional line, such as the cross-sectional line BB' shown in FIG. 3(*b*). The second cross-sectional line extends form the first section 510 to the third section 610. Besides, the two portions of the insulating element 300 separated by the second cross-sectional line, such as the right portion and the left portion, are mirror symmetrical.

Still referring to FIG. 3(*b*), the first stem 550 further includes at least one notch 555. The second stem 650 further includes at least one notch 655. As described above, the terminals of the coil of the inductor 100 shown in FIG. 2 are further wound around the notchs 555 of the first stem 550 and the notchs 655 of the second stem 650, thereby enhancing the combination. Even though the first stem 550 and the second stem 650 are bent, the terminals of the coil wound around the first stem 550 and the second stem 650 will not loosen. Therefore, according to the present invention, combining the terminals of the coil with the first stem 550 and the second stem 650 does not require welding.

Still referring to FIG. 3(*b*), in the first conductive element 500, the first section 510 connects with the second section 520 through the first step section 530. Similarly, in the second conductive element 600, the third section 610 connects with the fourth section 620 through the second step section 630. Therefore, as the top plan view shown in FIG. 3(*b*), the first conductive element 500 and the second conductive element 600 substantially are Z-shaped. Moreover, the third section 610 extends toward the first stem 550 and further crosses the second cross-sectional line BB'. The first section 510 extends toward the fourth section 620 and further crosses the second cross-sectional line BB'. As such, the first section 510 and the third section 610 enable the chassis 200 to resist the bending force along or parallel to the second cross-sectional line, such as the cross-sectional line BB'. Alternatively, the strength of the chassis 200 is enhanced enough and meanwhile the profile of the insulating element is thus reduced.

Figure 4A:
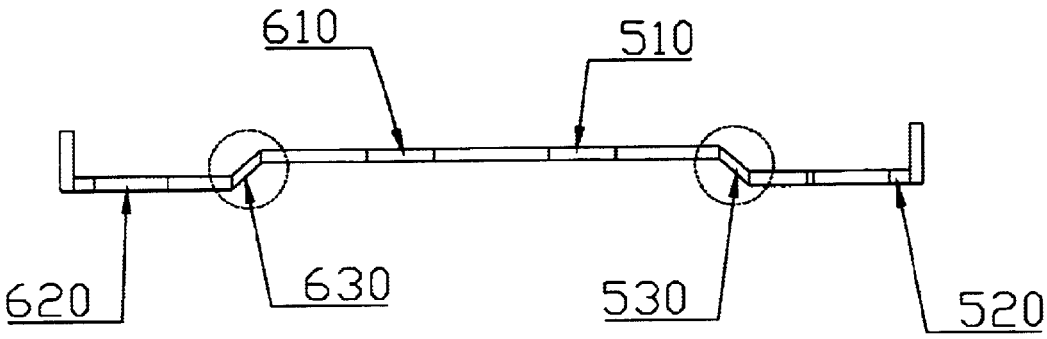
FIG. 4(*a*) depicts the side view illustrating the chassis according to the present invention.
Figure 4B:
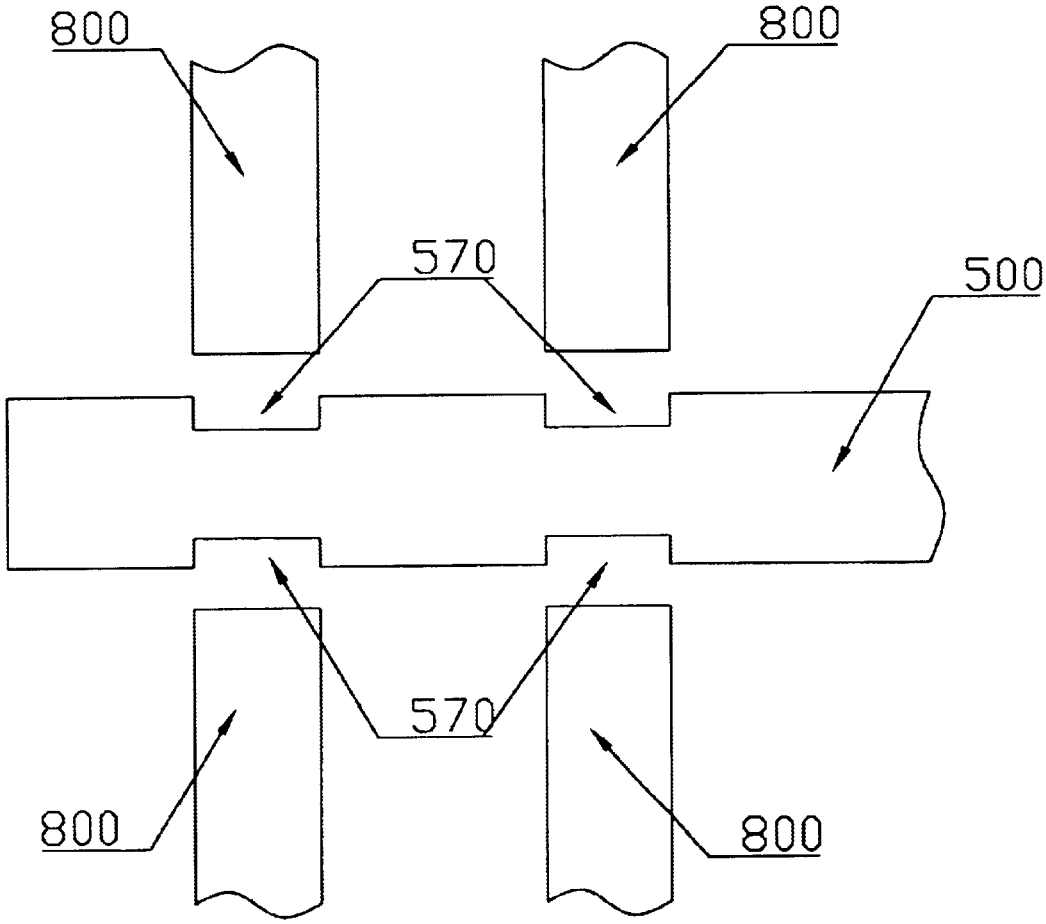

Refer to FIG. 4(*a*) showing the side view illustrating the first conductive element 500 and the second conductive element 600. Obviously, as shown in the dotted line, there is a drop formed between the first step section 530 and the second section 520. Besides, there is also a drop formed between the second step section 630 and the fourth section 620. Alternatively, the level of the second section 520 is lower than the level of the first step section 530. Besides, the insulating element 300 exposes the lower surface of the second section 520. Similarly, the level of the fourth section 620 is lower than the level of the second section 630. The insulating element 300 exposes the lower surface of the fourth section 620. Note that the lower surface of the second section 520, the lower surface of the fourth section 620 and the bottom surface of the chassis 200 are arranged on the same level. As such, the second section 520 and the fourth section 620 electrically contact the board having the chassis 200 mounted thereon. Therefore, the first section 510 and the third section 610 are far away from the board and form isolation therebetween.

Referring to FIG. 3(*b*) and FIG. 4(*b*) which shows the partially amplified side view illustrating the first or second conductive element, there is at least one second cavity 570 formed on the upper surfaces and the lower surfaces of the first conductive element 500 and the second conductive element 600, respectively. The second cavity 570 enables the clamp holder 800 to clamp the first conductive element 500 or the second conductive element 600 during molding. As such, the first conductive element 500 and the second conductive element 600 can resist the impact and thus be fixed properly during molding. The clamp holder 800 is removed after molding.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A chassis for an inductor having a core and a coil wound around the core, the chassis consisting of:

an insulating element;

a first conductive element including a first section, a second section, a first step section connected between the first and second sections, and a first stem connected to the second section, wherein the first section and the first step section are disposed inside the insulating element, the second section is embedded in the insulating element, and the first stem protrudes from the insulating element in a direction; and a second conductive element including a third section, a fourth section, a second step section connected between the third and fourth sections, and a second stem connected to the fourth section, wherein the third section and the second step section are disposed inside the insulating element, the fourth section is embedded in the insulating element, and the second stem protrudes from the insulating element in the direction, the chassis only having two stems which all radiate in the same direction.

2. The chassis according to claim 1, wherein said insulating element comprises an upper surface having a cavity formed thereon for accommodating said inductor.

3. The chassis according to claim 1, wherein said insulating element comprises a first flat bottom surface.

4. The chassis according to claim 1, wherein said first conductive element and said second conductive element are made of metal.

5. The chassis according to claim 1, wherein said insulating element is made of plastic.

6. The chassis according to claim 3, wherein the second section of the first conductive element has a second flat bottom surface, the fourth section of the second conductive element has a third flat bottom surface, and the first, second and third flat bottom surfaces are flush with each other.

7. The chassis according to claim 1, wherein the coil is further wound around the first stem.

8. The chassis according to claim 7, wherein the first stem is elongated and has at least one notch on one side thereof, and the coil is wound in the notches.

9. A chassis for an inductor, comprising:

an insulating element consisting of a first half portion and a second half portion wherein the first and second half portions are symmetric with respect to one axis;

a first conductive element including a first section and a second section, wherein the first section is embedded in the insulating element, and extends from the first half portion to the second half portion;

a second conductive element including a third section and a fourth section, wherein the third section is embedded in the insulating element and extends from the second half portion to the first half portion;

wherein the first section of the first conductive element and the third section of the second conductive element respectively extend across said axis for resisting bending forces across or parallel to said axis.

10. The chassis according to claim 9, wherein said first conductive element comprises an upper surface having at least one first cavity, and a lower surface having at least one second cavity, said cavities for receiving a clamp during molding.

11. The chassis according to claim 9, wherein said insulating element further comprises an upper surface having a cavity formed thereon for accommodating said inductor.

12. The chassis according to claim 9, wherein said insulating element further comprises a flat bottom surface.

13. The chassis according to claim 10, wherein said second conductive element comprises a lower surface, and said lower surface of said first conductive element and said lower surface of said second conductive element are arranged on the same level.

14. The chassis according to claim 9, wherein said first conductive element comprises a first stem, said second conductive element comprises a second stem, said first and second stems further comprise at least one recessed edge, respectively.

15. The chassis according to claim 14, wherein a coil of said inductor has two terminals wound around said respective recessed edges.

16. The chassis according to claim 9, wherein said first conductive element and said second conductive element are made of metal.

17. The chassis according to claim 9, wherein said insulating element is made of plastic.

* * * * *